United States Patent [19]

Wilburn et al.

[11] Patent Number: 4,956,111

[45] **Date of Patent: * Sep. 11, 1990**

[54] METHACRYLATE POUR POINT DEPRESSANTS AND COMPOSITIONS

[75] Inventors: Bruce E. Wilburn; William J. Heilman, both of Houston, Tex.

[73] Assignee: Pennzoil Products Company, The Woodlands, Tex.

[ * ] Notice: The portion of the term of this patent subsequent to Jul. 4, 2006 has been disclaimed.

[21] Appl. No.: 301,397

[22] Filed: Jan. 25, 1989

Related U.S. Application Data

[63] Continuation-in-part of Ser. No. 257,175, Oct. 13, 1988, Pat. No. 4,844,829, which is a continuation of Ser. No. 87,035, Aug. 19, 1987, abandoned.

[51] Int. Cl.[5] ..... G10M 105/22

[52] U.S. Cl. ..... 252/56 R; 252/52 R

[58] Field of Search ..... 252/56 R, 52 R

[56] References Cited

U.S. PATENT DOCUMENTS

| | | | |
|---|---|---|---|
| 2,091,627 | 8/1937 | Bruson | 87/9 |
| 2,544,376 | 3/1951 | Butler | 252/56 |
| 2,655,479 | 10/1953 | Munday | 252/56 R |
| 3,417,020 | 12/1968 | Preuss | 252/52 |
| 3,417,021 | 12/1968 | Engelhart | 252/56 |

(List continued on next page.)

FOREIGN PATENT DOCUMENTS

| | | |
|---|---|---|
| 3339103 | 9/1985 | Fed. Rep. of Germany . |
| 1559952 | 1/1980 | United Kingdom . |

OTHER PUBLICATIONS

Gavlin et al., "Pour Point Depression of Lubricating Oils", *Industrial and Engineering Chemistry,* vol. 45, 1953, pp. 2327 to 2335.

R. L. Stambaugh, "Low Temperature Pumpability of Engine Oils", Society of Automotive Engineers, Document No. 841388, 1984.

Clevenger et al., "Low Temperature Rheology of Multigrade Engine Oils–Formulary Effects", 1983, Society of Automotive Engineers, Inc., Publication No. 831716.

Henderson et al., "New Mini-Rotary Viscometer Temperature Profiles that Predict Engine Oil Pumpability", Society of Automotive Engineers, Inc., 1985, Document No. 350443.

Lorensen, "Symposium on Polymers in Lubricating Oil Presented Before the Division of Petroleum Chemistry", American Chemical Society, Atlantic City Meeting, Sep. 9–14, 1962, Preprint, vol. 7, No. 4.

Sales publication by Rohm GMBH, which relates to the Viscoplex Series of pour point depressants.

*Primary Examiner*—William R. Dixon, Jr.
*Assistant Examiner*—James M. Hunter, Jr.
*Attorney, Agent, or Firm*—Lowe, Price, LeBlanc, Becker & Shur

[57] ABSTRACT

A pour point depressant for lubricating oils comprises a poly(methacrylate) polymer having the repeating unit wherein R is an alkyl group having an average chain length in the polymer of 12.6 to 13.8, and n is an integer indicating the number of repeating units, the value of n being sufficient to provide a molecular weight of 10,000 to 300,000 for the polymer, the pour point depressant having the capacity to reduce the stable pour point to −35° C., while being compatible with other additives such as viscosity index improvers and detergents.

27 Claims, 4 Drawing Sheets

U.S. PATENT DOCUMENTS

| | | | |
|---|---|---|---|
| 3,507,932 | 4/1976 | Morduchowitz | 252/56 R |
| 3,598,736 | 8/1971 | van der Meij | 252/56 R |
| 3,598,737 | 8/1971 | van der Meij et al. | 252/56 R |
| 3,607,749 | 9/1971 | Forbes | 252/56 |
| 3,679,644 | 7/1972 | van der Meij | 252/56 R X |
| 3,814,690 | 6/1974 | Song | 252/56 D |
| 3,864,099 | 2/1975 | Ek | 252/51.5 A |
| 3,869,396 | 3/1975 | Van de Kraats | 252/56 R |
| 3,892,671 | 7/1975 | Song | 252/51.5 A |
| 3,897,353 | 7/1975 | Morduchowitz | 252/51.5 A |
| 4,021,357 | 5/1977 | Morduchowitz | 252/51.5 A |
| 4,045,376 | 8/1977 | Rubin | 252/56 S |
| 4,073,738 | 2/1978 | Ladenberger | 252/56 R |
| 4,088,589 | 5/1978 | Rossi | 252/56 R |
| 4,146,492 | 3/1979 | Cusano | 252/56 R |
| 4,149,984 | 4/1979 | Wenzel | 252/51.5 A |
| 4,203,854 | 5/1980 | Silverstein | 252/25 |
| 4,290,925 | 9/1981 | Pennewiss | 252/56 S |
| 4,533,482 | 8/1985 | Bollinger | 252/56 R |
| 4,606,834 | 8/1986 | Hart et al. | 252/51.5 A |
| 4,844,829 | 7/1989 | Wilburn | 252/56 R |

METHACRYLATE POUR POINT DEPRESSANTS AND COMPOSITIONS

CROSS-REFERENCE TO RELATED APPLICATIONS

This application is a continuation-in-part of Ser. No. 07/257,175 filed Oct. 13, 1988, now U.S. Pat. No. 4,844,829, which is a continuation of application Ser. No. 087,035, filed Aug. 19, 1987, now abandoned.

FIELD OF THE INVENTION

This invention relates to pour point depressants for use in lubricating oils and more particularly to a new and novel class of poly(methacrylate) polymeric pour point depressants which provide substantial advantages when used in lubricating oils.

BACKGROUND

Wax-bearing lubricating oils are known to set to a semi-plastic mass on cooling below the temperature of the crystallization point of the wax contained in the lubricating oil. This change is measured in terms of pour point which may be defined as the temperature at which the oil sample is no longer considered to flow when subjected to the standardized schedule of quiescent cooling prescribed by ASTM D97-47. This problem presents a substantial disadvantage in the use of lubricating oils by the petroleum industry.

The problem with lubricating oils which contain any amount of waxes is that the wax contained in the oil, which is a paraffinic oil, will crystallize when the oil is cooled, and networks of wax crystals will then form on further cooling which will prevent the oil from flowing. The point at which the oil stops flowing is defined as the pour point temperature. Dewaxing of an oil improves the pour point, but this is an expensive procedure. Usually, the procedure is to dewax an oil to a certain temperature and then add pour point depressants to improve the low temperature properties. However, at the lower temperature, the same amount of wax will still separate. The pour point depressants do not make the wax more soluble in oil; they function rather by disrupting or preventing the formation of the waxy network As little as 0.2 wt. % of a good pour point depressant can lower the pour point of the paraffinic oil or lubricating composition by 30°-35° C.

The wax networks will also lead to an increase in oil viscosity. The increase in viscosity is generally temporary as a "normal" internal combustion engine can generate sufficient shear to disrupt the wax networks and allow the oil to flow. However, it should be emphasized that while the physical turning or cranking of the engine is usually unimpeded, the temporary disruption in the oil flow can lead to an increase in bearing wear.

Studies have indicated that the amount of wax needed to prevent flow or gel for an oil is quite small. Approximately 2% precipitated wax will gel middle distillates, and a similar amount is needed for lubricating oils.

Many different types of pour point depressants have been used in the prior art. Previously used pour point depressants are predominantly oligomers having molecular weights of 1,000 to 10,000, or polymers which have molecular weights greater than 10,000. The early point depressants were either alkylated aromatic polymers or comb polymers. Comb polymers characteristically have long alkyl chains attached to the backbone of the polymer, with the alkyl groups being of different carbon chain lengths.

The mechanism of action for pour point depressants has been the subject of much interest. Early indications were that alkylated aromatic compounds function as pour point depressants by coating the surface of the wax crystals and preventing further growth. More recently, however, it appears that the pour point depressants are either absorbed into the face of the wax crystal if the pour point depressant is an alkyl aromatic or co-crystallize with the wax crystal if it is comb polymer. Thus, crystal growth is not prohibited, it is simply directed or channeled along different routes. Light microscopy suggests that wax crystals are typically thin plates or blades, and when a pour point depressant is added to the system, those crystals are smaller and more branched, and thus the pour point depressant may disrupt or redirect crystal growth from different directions into a single direction and bulkier crystals will be formed. These crystals then can form networks only at much lower temperatures which results in a lower pour point.

Reports on pour points studies may be found in the publication by Gavlin et al entitled "Pour Point Depression of Lubricating Oils", *Industrial and Engineering Chemistry,* Vol. 45, 1953, pages 2327 to 2335. Also of interest in background with respect to pour point depressants is the publication by Clevenger et al, entitled "Low Temperature Rheology of Multigrade Engine Oils—Formulary Effects", 1983 Society of Automotive Engineers, Inc., Publication No. 831716; a publication by Henderson et al entitled "New Mini-Rotary Viscometer Temperature Profiles that Predict Engine Oil Pumpability", Society of Automotive Engineers, Inc. 1985, Document No. 850443; a publication by Lorensen, "Symposium on Polymers in Lubricating Oil Presented Before the Division of Petroleum: Chemistry, American Chemical Society, Atlantic City Meeting, Sept. 9-14, 1962, Preprint, Vol. 7, No. 4; and a publication by R. L. Stambaugh entitled "Low Temperature Pumpability of Engine Oils", Society of Automotive Engineers, Document No. 841388, 1984.

As pointed out above, the most recent interest in pour point depressants is found in poly(methacrylate) polymers. Indeed, methacrylate/acrylate polymers appear to be the most popular class of pour point depressants now in use. There is available commercially a line of poly(methacrylate) pour point depressants from the Rohm and Haas Company under the tradename Acryloid. Also available are similar products from Texaco under a trade designation of TLA followed by a numerical suffix or TC followed by a numerical suffix.

There has also been substantial patent activity concerned with pour point depressants which comprise poly(methacrylate) compositions. Thus U.S. Pat. Nos. 3,607,749 and 4,203,854 disclose poly(methacrylate) as viscosity index improvers, but without any data as to their low temperature performance. In particular, U.S. Pat. No. 3,607,749 discloses a blend of a high molecular weight polymethacrylate with a low molecular weight polymethacrylate as a viscosity index improver.

U.S. Pat. No. 3,598,736 discloses the addition of small amounts of oil soluble polymethacrylates to lubricating oils to reduce the pour point. The polyalkylmethacrylates are described as copolymers wherein the alkyl side chain contains from 10 to 20 carbon atoms with an average of between 13.8 and 14.8 carbon atoms. U.S. Pat. No. 3,679,644 is a division of U.S. Pat. No. 3,598,736 and contains the same disclosure.

U.S. Pat. No. 4,073,738 discloses the use of a pour point depressant which comprises an alkyl acrylate or alkyl methacrylate wherein the alkyl group side chain can have from 8 to 30 carbon atoms and preferably from 8 to 22 carbon atoms.

U.S. Pat. No. 4,088,589 discloses a combination of pour point depressants of which one can be an oil soluble polymer of an alkyl acrylate or methacrylate which contains a side chain comprising 10 to 18 carbon atoms in the alkyl group.

U.S. Pat. No. 2,655,479 of Munday et al is directed to polyester pour depressants and is particularly concerned with average side chain length of acrylate polymer pour depressants. The patent states in column 3, beginning at line 49 that polymers of single esters or homopolymers are not good pour point depressants but that copolymers are generally good pour point depressants. At column 4, beginning at line 44, it is stated that it is necessary that the average side chain length be in the range of about 11.0 to about 13.5 carbon atoms per mol of monomer. However, this patentee uses a combination of two polymers to obtain this side chain length and the results are unsatisfactory.

U.S. Pat. No. 3,598,737 discloses lubricant compositions which contain copolymers of acrylate esters which are said to improve various characteristics including pour point. This patent states that the average number of carbon atoms should be at least 12.5 to 14.3. These compounds do not appear to be acrylate esters wherein the side chain is this value, but rather this patent shows the use of hydroxyalkyl esters in a poly(methacrylate).

U.S. Pat. No. 3,897,353 discloses oil compositions comprising lubricating oil and a pour depressant which can be an alkylmethacrylate. These acrylates may be made from monomers wherein the alkyl portion of the ester or the side chain has from 12 to 18 carbon atoms and includes mixtures. However, the polymers of this patent are made from nitrogen-containing monomers.

The present invention, however, provides a pour point depressant based on poly(methacrylate) polymeric compositions which represent a narrow class of such compositions and which have advantageous properties in improving the low temperature properties of lubricating compositions while maintaining a good viscosity index.

SUMMARY OF THE INVENTION

It is accordingly one object of the present invention to provide a new and improved pour point depressant composition.

A further object of the invention is to provide a unique and advantageous poly(methacrylate) polymer useful as a pour point depressant in lubricating oils.

A still further object of the present invention is to provide a lubricating oil composition which contains a pour point depressant comprising a poly(methacrylate) polymeric material having an alkyl side chain of critical carbon chain length.

Other objects and advantages of the present invention will become apparent as the description thereof proceeds.

In satisfaction of the foregoing objects and advantages, there is provided by this invention a pour point depressant for lubricating oils which comprises a poly(methacrylate) polymer having the repeating unit

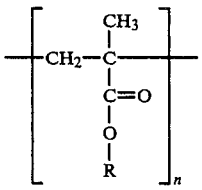

wherein R is an alkyl group having an average chain length in the polymer of 12.6 to 13.8, preferably 12.6 to 13.3, and n is an integer indicating the number of repeating units, the value of n being sufficient to provide a molecular weight of 30,000 to 220,000 for the polymer, said polymer being a polymer formed from at least three but less than five methacrylate monomers with no individual monomer present in an amount less than 10–15 wt. %.

Also provided by the present invention is a lubricating oil which contains an effective amount of the novel poly(methacrylate) polymer, the effective amount being sufficient to provide an oil which meets the Federal Stable Pour for a 5W-30 lubricating oil.

BRIEF DESCRIPTION OF THE DRAWINGS

Reference is now made to the drawings accompanying the application wherein.

DESCRIPTION OF PREFERRED EMBODIMENTS

Figure 1:
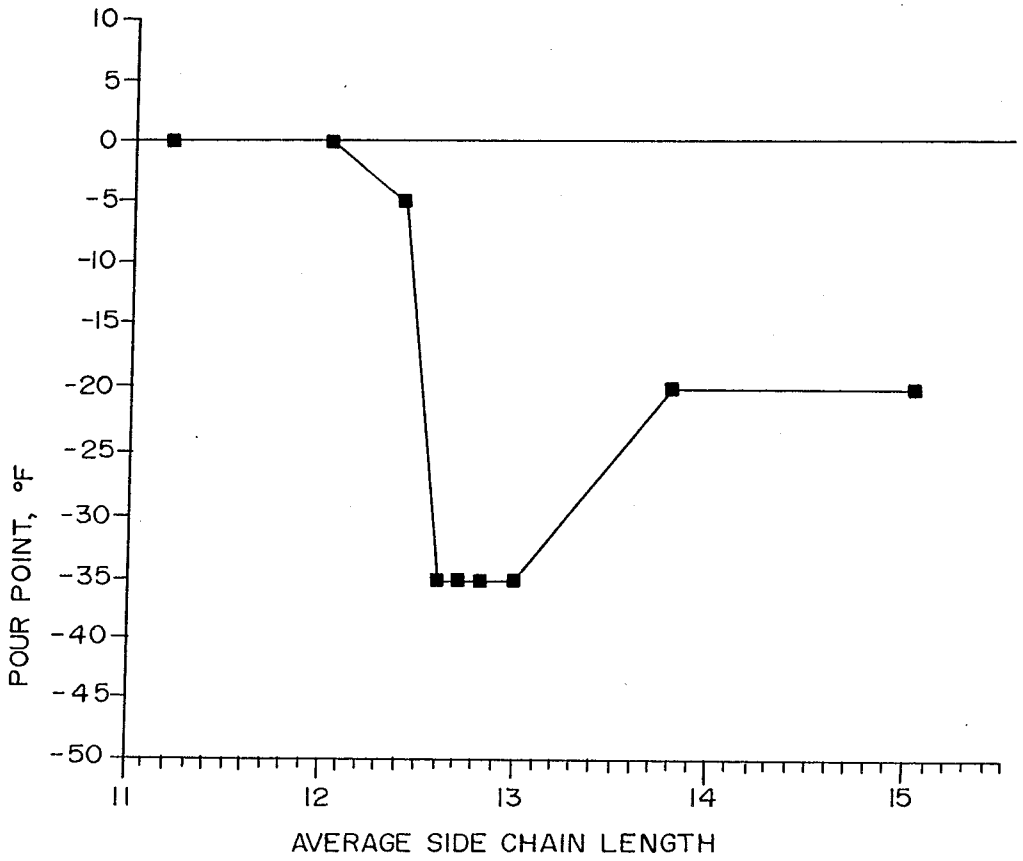
FIG. 1 is a graph showing the D-97 pour point effectiveness of a polymer of the invention.

As pointed out, above, this invention relates to a new class of pour point depressants and lubricating oils which contain such pour point depressants. The pour point depressants of the present invention comprise a selective group of poly(methacrylate) polymers which have the following repeating unit:

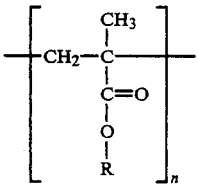

I.

In the above repeating unit, R is an alkyl group having an average carbon chain length in the polymer of 12.6 to 13.8, preferably 12.6 to 13.5 and more preferably 12.8 to 13.3, and n is an integer indicating the number of repeating units, the value of n being sufficient to provide a molecular weight of 10,000 to 300,000, preferably 30,000 to 220,000 for the polymer, the polymer having been prepared from at least three but less than five methacrylate monomers in the $C_{10}$ to $C_{16}$ range with no individual monomer present in an amount less than 10–15 wt. % and preferably not less than 20 wt. %.

It has been found according to the present invention that for a polymethacrylate to be effective as a pour point depressant in a lubricating oil, it must have an average side carbon chain length of 12.6 to 13.8 carbon atoms, and preferably 12.6 to 13.3 carbon atoms. Furthermore, it has been found that whether the formulation will pass or fail the low temperature limits for a lubricating oil formulation will depend, in large measure, on the number and kind of side chains present in the pour point depressant. When a polymethacrylate pour point depressant of this type is used in conjunction with a compatible viscosity index improver, a lubricating oil of the 5W-30, 10W-30, 10W-40 and 15W-40 qualities can be produced to provide a formulation which will pass the required low temperature tests for such oils.

Successful formulations for 5W, 10W and 15W lubrication oils are as follows:

| Low temperature performance requirements of 5W, 10W, and 15W oil | | | |
|---|---|---|---|
| 5W | 18 hr MRV viscosity <30,000 at −30° C. | TP-1 MRV viscosity <30,000 cP at −35° C. Yield Stress <35 pa | Stable pour, °C. ≦−35 |
| 10W | <30,000 at −25° C. | <30,000 cP at −25° C. Yield Stress <35 pa | ≦−30 |
| 15W | <30,000 at −20° C. | <30,000 cP at −20° C. Yield Stress <35 pa | ≦−25 |

A complete discussion of the low temperature rheology of multi-grade engine oils may be found in the publication by Clevenger et al, Document 831716, of the Society of Automotive Engineers, 1983. This publication sets forth the specifications for various grades of engine oils, particularly as may be seen in Table 1 on page 2 of the publication.

In this application, the reference to average side carbon chain length refers to the length of the carbon chain (R in the formula) in the alkyl group on the ester moiety. The carbon chain length is determined by the alcohol used to esterify the methacrylic acid in preparation of the methacrylate monomer.

In this invention it has been discovered that the average side chain length (R) of a poly(methacrylate) pour point depressant must be in the range of 12.6 to 13.8, preferably 12.6 to 13.5, and more preferably 12.8 to 13.3. This average side chain length of the polymer has been found to depress the D-97 pour point of a suitable oil from 0° to −35° F. Alkyl side chain averages lower than this do not provide acceptable results, and polymers with side chain averages larger than 13.5 lower the pour point a lesser amount.

In this invention it has been discovered that the identity and number of the ester side chains present in the pour point depressant determines the effectiveness of the formulation as measured by the above tests, i.e., stable pour and TP-1 MRV viscosities. According to this invention, it has been found that only certain specific combinations of average side chain alkyl length provide acceptable results.

The poly(methacrylate) pour point depressants of this invention are described as having an average side chain carbon length of 12.6 to 13.8, preferably 12.6 to 13.5, and more preferably 12.8 to 13.3. This value is obtained by using the correct mix of monomers in preparation of the polymer. The polymer is prepared by preparation of the monomers, mixing and blending properly and then subjecting to polymerization. The appropriate mix to obtain an average side chain in the range of 12.6 to 13.8 carbon atoms requires a mixture of at least three monomers of a mixture of $C_{10}$ to $C_{16}$ monomers but less than five such monomers. These references to side chains refer to the esterified portion of the methacrylate or R in Formula I as the carbon chain is supplied by the alcohol used for esterification. For example, a formulation of monomers which includes 35–38% of $C_{10}$ monomers, 31–34% $C_{14}$ monomers and 28–34% $C_{16}$ monomers will provide a polymer having an average chain length of 12.68 to 13.0. It is within the scope of the present invention, however, to select any combination of at least three but less than five methacrylate monomers in the $C_{10}$ to $C_{16}$ range, with no monomer present in less than 10–15 wt. % which will provide the final polymethacrylate polymer with an average side chain length, or value of R, of 12.6 to 13.50.

As will be apparent from the structure of the polymer, the variations in the chain length are provided by the alcohol which is used to form the ester monomer of methacrylic acid. Thus, the value of R in the monomer may range from $C_8$ to $C_{20}$, but more preferably from about $C_{10}$ to $C_{16}$. A preferred group of monomers will have the value of R ranging from $C_{10}$ to $C_{16}$. The resulting product is therefore a polymer in which the value of R may range from $C_8$ to $C_{20}$, but wherein the average value or average carbon chain length for R is 12.6 to 13.30 provided that the average is obtained with at least three but less than five monomers in the $C_{10}$ to $C_{16}$ range where the minimum concentration of each monomer is at least 10–15% by weight.

The method of calculation of the average side chain carbon length in this invention is the method disclosed in column 4, lines 31–49 of U.S. Pat. No. 3,814,690 where a method for calculating "mole equivalent average chain length" is discussed. This value is essentially the same as "average side chain length, Cav" in this patent application. The following formula is used:

$$\frac{(CN_1)(MP_1) + (CN_2)(MP_2) + \ldots + (CNn)(MPn)}{MP_1 + MP_2 + \ldots MPn}$$

when $CN_1$ is the number of chain carbons in the first chain, $CN_2$ is the number of chain carbons in the second chain, $CN_n$ is the number of chain carbons in the nth chain, $MP_1$ is the mole percent of first component, $MP_2$ is the mole percent of the second component, $MP_n$ is the mole percent of the nth component. Mole percent is equal to the mole fraction times 100%.

As shown in the examples described hereinafter, the pour point of the base oil alone can be depressed with any combination of chains that will yield a 12.6–13.50 chain average; however, with formulated oils the 3 to 5 monomers in the $C_{10}$ to $C_{16}$ range must be carefully chosen as not all combinations will work with ethylene-propylene viscosity index (VI) improvers. Any synergistic mixture of monomers to produce a polymer having this average side chain length or value of R is considered to be within the scope of the invention.

The monomers and resulting terpolymers may be produced by methods well known to the art described, for example, in U.S. Pat. Nos. 3,598,736, and 4,088,589, the disclosures of which are incorporated herein by reference.

As indicated above, a pour point depressant is used in a lubricating oil or engine oil in order to provide a resulting formulation which will pass the low temperature tests required for such fluids, such as the Federal Stable Pour test. The pour point depressant is often used in combination with a viscosity index improver, VI, of which many different types are available. For example, ethylene/propylene viscosity index improvers are particularly available from Amoco. Other viscosity index improvers sold under the name TLA, which are ethylene-propylene copolymers to which a vinyl pyrrolidone has been grafted to provide dispersing characteristics, may also be used with such formulations. Certain chain combinations of the pour point depressant will function with one or the other VI improvers even though the pour point depressant has the requisite 12.6–13.50 side chain average.

The pour point improvers are normally used with a suitable lubricating fluid or engine oil. A preferred lubricating oil of this type is sold by Pennzoil Company under the tradename Atlas, and particularly Atlas 100N or Atlas 325N. Other base stocks such as, but not limited to, Ashland 100N or Exxon 100 LP are also suitable for use. The lubricating oil may be a 5W-30, 10W-30, 10W-40 or 15W-40 grade.

As a result of Applicants' research in this area, it has been discovered that an effective pour point depressant will have an average side chain length of 12.6 to 13.8, preferably 12.6 to 13.5, more preferably 12.6 to 13.3 and this will depress the D-97 pour point of a lubricating fluid such as Atlas 100N from 0° down to −35° F. Where the value of R or the side chain length is lower than 12.6, a pour point depressant is provided which is not effective to meet industry standards. Polymers with side chain averages higher than 13.50 will lower the D-97 pour point only to about −20° F. To achieve the effective side chain average of 12.6 to 13.50, the polymers are formed from a group of indicated monomer components to provide the best results. The 3 to 5 monomers in the $C_{10}$ to $C_{16}$ range must be carefully chosen as not all combinations will work with ethylene-propylene VI improvers.

There is also a requirement that the molecular weight of the polymer of the invention have a lower limit of about 30,000 dalton and an upper limit in the range of 220,000 dalton. Thus the degree of polymerization is also important.

The amount of pour point depressant of this invention to be added to the lubricating oil will range from 0.001 to 1.0 wt. % and preferably range from about 0.01 to 0.50 wt. % when the pour point depressant is a concentrate. The amount of viscosity index improver added is preferably about 5 to 20 wt. %.

The lubricating oil composition will also preferably contain a detergent composition such as the commercially available detergent packages. The pour point depressant compositions of this invention are compatible with all such detergent packages.

Several different detergent packages are available for use in the invention, and are preferably used at the SG level of detergency. The American Petroleum Institute, API, has established different service i.e., protection classification levels, for lubricating oils. Several different engine tests that emphasize different aspects of engine performance must be passed to allow the oil to be certified at that level. For example, the SE classification was introduced in 1972.

Formulated oils that met this classification level offered more protection against corrosion, oil oxidation, rust and engine deposits than earlier oils. The SF category was introduced in 1980. Formulated oils that met this classification level had better oxidative stability and anti-wear performance than SE oils. The SG level was introduced in 1988. Formulated oils that met this classification level had better sludge control and anti-wear performance than SF oils. The improvement in anti-wear performance is needed because of the extended warranties that are currently available. The trend has been for formulated oils to meet more exacting performance requirements dictated by today's smaller more demanding engines. Detergent package F uses polyisobutylene dispersant chemistry. Detergent package G is a spike composed of calcium phenates and sulfonates to give additional performance. Detergent package I uses Mannich dispersant chemistry. Detergent package I is approximately 23 wt % dispersant. Detergent package J employs polyisobutylene succinimide dispersant chemistry. The above description is merely qualitative as these packages are composed of other additives that serve different purposes.

Reference is now made to the drawings accompanying the application, wherein FIG. 1 is a graph illustrating how the D-97 pour point of the lubricating fluid Atlas 100N changes with the average side chain length or the number of carbons for the value of R.

Figure 2:
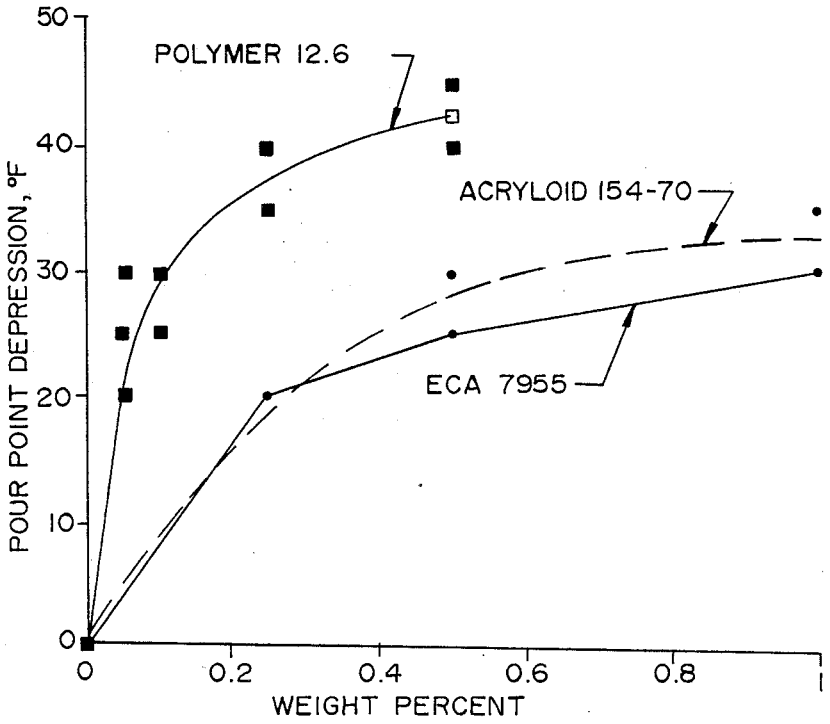
FIG. 2 is a graph comparing the D-97 pour points of a polymer of this invention with those of a commercial product.

In FIG. 2, there is a comparison of the D-97 pour point depression in degrees F of the lubricant Atlas 100N containing a polymer of this invention with commercial polymers Acryloid 154-70 and ECA 7955 based on concentration. It will be seen that one polymer of this invention, indicated as Polymer 12.6, (Polymer 4 from Table 1), the 12.6 indicating the average chain length or value of R, shows substantially greater D-97 pour point depression than Acryloid 154-70 or ECA 7955.

Figure 3:
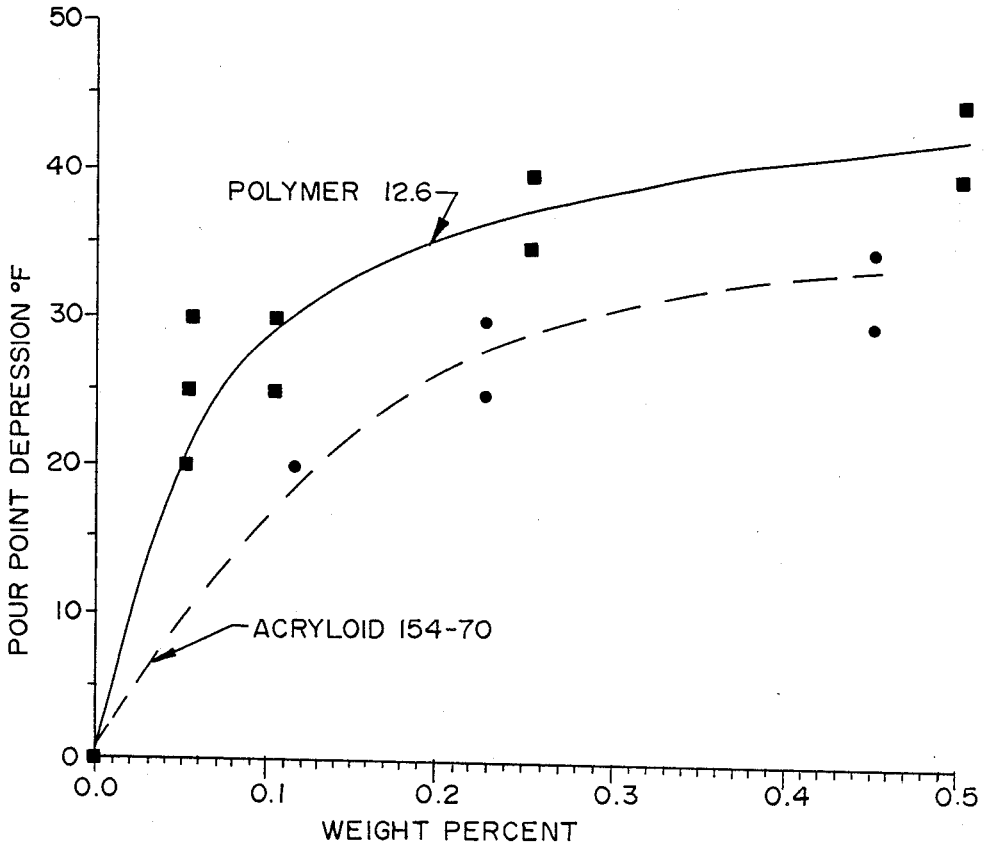
FIG. 3 is a graph similar to FIG. 2 but with correction of a concentration of a commercial product.

FIG. 3 illustrates the D-97 pour point of the lubricant Atlas 100N containing Polymer 12.6 in comparison with Acryloid 154-70 versus weight percent concentration of the depressant but wherein the Acryloid 154-70 has had its concentration corrected to account for the diluent oil.

Figure 4:
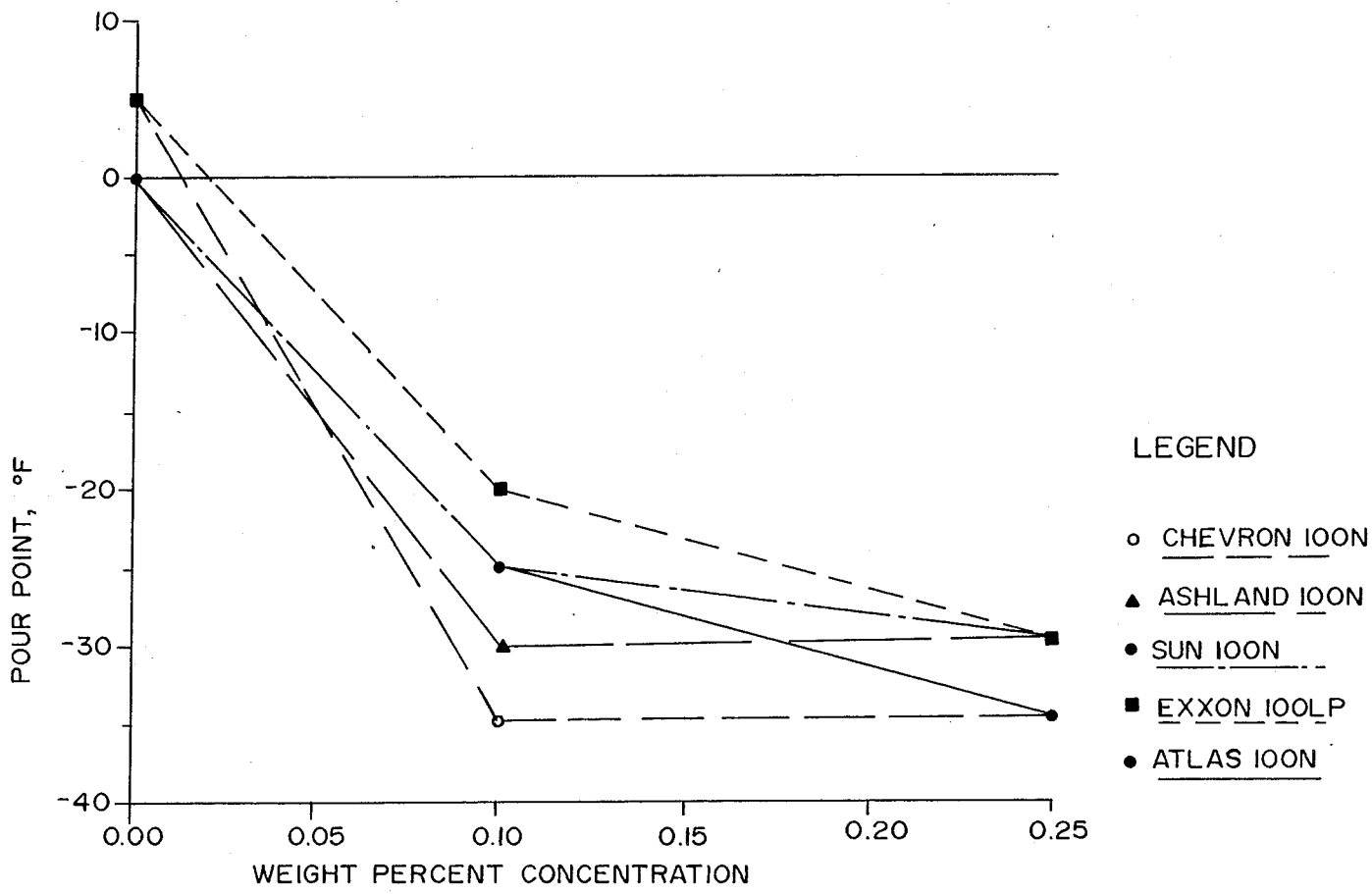
FIG. 4 is a graph showing the D-97 pour point effectiveness of a polymer of the invention in different base stocks.

FIG. 4 displays the activity of polymer 12.6 in different base stocks. At 0.25 wt. %, the base stocks have D-97 pour points of −30° to −35° F., indicating the pour point depressant activity is not limited solely to Atlas 100N.

The following examples are presented to illustrate the invention, but the invention is not to be considered as limited thereto. In the examples and throughout the specification, parts are by weight unless otherwise indicated.

EXAMPLE 1

In the following Table 1, the polymethacrylate polymer compositions set forth in Experiments 1–13 were prepared using the monomers indicated as $C_4$, $C_{10}$, $C_{11}$, $C_{12}$, $C_{14}$ and $C_{16}$. Thus, the polymers were produced using a combination of methacrylic acid esters wherein the alcohol used to esterify the methacrylic acid had the indicated C value. For example, in Experiment 1, the polymer was prepared from a mixture of three monomers, 45.1% $C_{10}$, 43.1% $C_{12}$ and 11.8% $C_{14}$ for a chain length average of 11.2. In the polymers described in the table, the chain length distribution (normalized weight distribution) was determined by gas chromatography on an SE-30 column of the methacrylate monomer mixture prior to polymerization. In one example, the monomer mixtures was isolated after polymerization, and the composition was nearly the same as the initial charge. Polymerizations were conducted in xylene under a nitrogen atmosphere with benzoyl peroxide the free radical initiator. Reactions were conducted at 85°-95° C. for a period of several hours. Molecular weights were measured by gel permeation chromatography, relative to polystyrene.

The neat polymers were dissolved at 0.25 wt. % in the lube oil Atlas 100N. The pour points were determined by the D-97 test. The results are also displayed in Table 1. A graph of the pour point of Atlas 100N as a function of the average side chain length of the poly-methacrylate) PPD is shown in FIG. 1.

TABLE 1

| Poly(methacrylate) composition[a] and Pour Points of Atlas 100N[b] | | | | | | | | | | |
|---|---|---|---|---|---|---|---|---|---|---|
| | | | | | | | | Molecular Weight | | Pour Point |
| Polymer | $C_4$ | $C_{10}$ | $C_{11}$ | $C_{12}$ | $C_{14}$ | $C_{16}$ | Cav | $\overline{Mw}$ | $\overline{Mn}$ | (°F.) |
| 1 | — | 45.1 | — | 43.1 | 11.8 | — | 11.2 | 22,800 | 8,200 | 0 |
| 2 | — | — | — | 100 | — | — | 12.0 | 54,400 | 15,500 | 0 |
| 3 | — | — | — | 79.5 | 20.5 | — | 12.4 | 57,100 | 12,200 | −5 |
| 4 | — | — | — | 67.6 | 26.6 | 5.0 | 12.6 | 63,500 | 17,200 | −35 |
| 5 | — | — | 46.7 | — | 36.4 | 16.9 | 12.7 | 56,200 | 12,500 | −35 |
| 6 | — | — | 49 | — | 35 | 16 | 12.7 | 34,000 | 5,100 | −35 |
| 7 | 13 | — | 43 | — | 31 | 14 | 12.7 | 30,500 | 4,000 | −35 |
| 8 | — | — | — | 61.7 | 32.0 | 6.0 | 12.8 | 57,000 | 13,500 | −35 |
| 9 | — | — | — | 60 | 40 | — | 12.8 | 57,000 | 13,500 | −35 |
| 10 | — | 35.1 | — | — | 31.45 | 33.4 | 13.0 | 39,900 | 11,700 | −35 |
| 11 | — | — | — | 39.9 | 30.1 | 30.0 | 13.8 | 31,600 | 11,900 | −20 |
| 12 | — | — | — | 8.8 | 27.4 | 63.7 | 15.0 | 27,000 | 9,000 | −20 |
| 13 | — | — | — | 61.7 | 31.9 | 6.0 | 12.8 | 4,300 | 2,100 | 0 |

[a]normalized weight distribution
[b]concentration is 0.25 Wt.%.

Analysis of the data of Table 1 reveals the following conclusions:

(1) An average side chain length of 12.6–13.50 will depress the D-97 pour point of a lube oil of this type from 0° to −35° F. Side chain averages lower than this, Polymers 1-3, do not work; polymers with side chain averages larger than this range, Polymers 11 and 12, only lower the pour point to −20° F.

(2) Within the effective side chain average of 12.6–13.50, polymers with two components (Polymer 9) work as well as polymers with 3 components (polymer 8). A variety of 3 component chains work, (e.g., Polymers 4, 5 or 10).

(3) There is a lower limit on the Mw that a polymer needs to function. Polymer 13 has an Mw of 4300 but does not work while polymer 6 functions with a Mw of 34,000. A Mw of about 30,000 is considered a reasonable lower limit.

(4) There is no difference in effectiveness of the pour point depressants once the lower limit has been reacted. Polymers 5 and 6 are equally effective even though Polymer 5 has Mw of 56,200 and Polymer 6 has an Mw of 34,000.

(5) The effectiveness of Polymer 7 in the lube oil indicates that short chain groups may be present on the polymer but will not interfere with the polymer's effectiveness so long as the average is within the range 12.6–13.50.

EXAMPLE 2

These pour point depressants also compare favorably with commercially available products such as ECA 7955 or Acryloid 154-70. ECA 7955, available from Paramins, is a fumarate or vinyl acetate/fumarate copolymer with Mw=35,000, and Mn=12,000. Acryloid 154-70 is poly(methacrylate) oil concentrate commercially available from Rohm and Haas. The poly(methacrylate) has Mw of 78,000 and Mn=33,700. The polymer was isolated from the oil by repeated precipitation from methanol. The oil free polymer was then subjected to pyrolysis GC mass spectrometry. The normalized chain distribution was 18% $C_{12}$, 21% $C_{13}$, 21% $C_{14}$, 16% $C_{15}$, 15% $C_{16}$ and 8% $C_{18}$ with Cav ~ 14.

Atlas 100N was blended with several different concentrations of Polymer 4 (Table 1), ECA 7955 or Acryloid 154-70. The D-97 pour points are depicted graphically in FIG. 2 with Polymer 4 being referred to as Polymer 12.6. The graph is somewhat misleading because the commercial pour point depressants are sold as concentrates so that the actual polymer concentration is less than what is displayed. The MS-DS for Acryloid 154-70 states that the concentrate is 40–45 wt. % polymer. FIG. 3 shows the Atlas 100N D-97 pour points with the corrected concentration shown for Acryloid 154-70. Polymer 4 depresses the pour better and to a lower overall level than does Acryloid 154-70.

EXAMPLE 3

In this example, several of the poly(methacrylates) described in Table 1, together with several additional polymethacrylates which had the desired average side chain length of 12.6 to 13.0 carbon atoms, were prepared for testing. The composition and molecular weight distribution of this latter group of polymethacrylate pour point depressants is described in Table 2. Table 2 illustrates how polymethacrylate pour point depressants within the scope of the invention can be prepared using different combinations of monomeric components. Thus, the monomers were methacrylates wherein the esterifying alcohol had a carbon chain ranging from 10 carbons to 16 carbons, so that the average carbon chain length for the polymers ranged from 12.68 to 12.85. Table 2 is as follows:

TABLE 2

| Polymethacrylate Pour Point Depressants | | | | | | | | |
|---|---|---|---|---|---|---|---|---|
| | | | | | | | Molecular Weight | |
| Polymer | $C_{10}$ | $C_{11}$ | $C_{12}$ | $C_{14}$ | $C_{16}$ | Cav | $\overline{Mw}$ | $\overline{Mn}$ |
| 14 | 38.8 | — | — | 32 | 28 | 12.68 | 68,000 | 13,300 |
| 15 | — | 33 | 27 | 21.8 | 18.9 | 12.70 | 47,800 | 11,400 |
| 16 | 24.2 | — | 24.4 | 25.7 | 25.3 | 12.8 | 40,600 | 12,200 |
| 17 | 22 | 24 | — | 26 | 29 | 12.75 | 37,500 | 11,600 |
| 18 | 16 | 18 | 20 | 21.8 | 24.1 | 12.85 | 49,800 | 13,500 |

TABLE 2-continued

| Polymethacrylate Pour Point Depressants | | | | | | | | |
|---|---|---|---|---|---|---|---|---|
| | | | | | | | Molecular Weight | |
| Polymer | $C_{10}$ | $C_{11}$ | $C_{12}$ | $C_{14}$ | $C_{16}$ | Cav | $\overline{Mw}$ | $\overline{Mn}$ |
| 19 | 35.8 | — | — | 33.8 | 30.3 | 12.83 | 139,000 | 30,000 |
| 20 | 36.33 | — | — | 35.25 | 28.42 | 12.80 | 195,700 | 65,300 |

EXAMPLE 4

In this example of a formulation study with Viscosity Index Improvers and other additives, formulations are prepared to represent a motor oil having the proper components to meet the Federal Stable Pour, the MRV test, the CCS, the TP-1 cooling cycles. In Table 3, the heading for PPD Polymer refers to the numbered polymer prepared in Tables 1 and/or 2. The VI improver A is an olefin copolymer of ethylene-propylene to which vinyl pyrrolidone has been grafted to give dispersing characteristics. It has a molecular weight of about 180,000. Atlas 100N is the base oil to which these components are added in the amounts indicated.

In this example, two dispersant olefin copolymers Viscosity Index improvers were used in the formulations. VI improver A has a Mw~ of 189,000 and Mn of 43,000. VI improver B has a bimodal molecular weight distribution. The lower fraction has an Mw of 9,000 and Mn of 76,750. The higher fraction has an Mw¢ of 1,000,000.

Many of the poly(methacrylates) described in Table 1, along with several additional polymethacrylates that had the desired average side chain length of 12.6–13.3 carbon atoms, were tested in the formulations. The composition and molecular weight distribution of this latter group of poly(methacrylate) PPDs is described in Table 2.

Polymers 19 and 20 were prepared in Atlas 100N and used as concentrates with an effective polymer concentration of 25–35% wt. The Viscosity Index Improver A blends with their D-97 pour points, Federal Stable Pour, −25° C. CCS viscosities, the CCS, the −30° C. viscosity as measured in the MRV with an 18 hour (D 3829) and TP-1 cooling cycles, and 100° C. viscosities are displayed in Table 3. The results of the Viscosity Index Improver B formulations are shown in Table 4.

Both series of formulations used detergent package A. Detergent package A consists of a borated succinate ester dispersant with a mixture of calcium and magnesium phenates used as detergents. Other detergent packages were used (see below); detergent package B was composed of a polyisobutylene succinimide dispersant with a magnesium sulfonate detergent; detergent package C contained a polyisobutylene succinimide dispersant with a calcium sulfonate detergent; detergent package D contained only a calcium sulfonate detergent and detergent package E, which has similar constituents as detergent package A but with less calcium phenate. Detergent packages C and D were used together. All detergent packages contained zinc dialkyldithiophosphates. Detergent packages are items of commerce with varied ingredients and methods of preparation, some of which are trade secrets, such that the exact nature or number of components cannot be readily determined. Consequently the above description of the detergent packages is qualitative and is not exhaustive.

Olefin Copolymer VI Improver A Formulations

Formulations 4A, 5B, 10A, 10B, 12A and 12B met the following low temperature standards for a 5W-30 oil; a CCS viscosity of ≦3,500 cP at −25° C., a Federal Stable Pour of ≦−35° C., and a MRV viscosity of ≦30,000 cP at −30° C. with the D-3829 and TP-1 cooling cycles.

Formulations 4A, 5B, 10A, 10B, 12A and 12B used polymers with chain compositions that were 35–38% C10, 31–34% $C_{14}$, and 28–34% $C_{16}$ with a side chain average of 12.68-13.0. The polymers are identical except for the molecular weight. Polymer 10, used i formulations 4A–C, has Mw of 39,900 and Mn of 11,700. Polymer 14, used in formulations 5A–B, has a Mw of 68,000 and Mn of 13,300. Polymer 19, used in formulations 10A and 10B has a Mw of 139,000 and Mn of 30,000. Polymer 20 had a Mw of 195,700 and a Mn of 65,300. While all of the polymers will produce successful formulations, higher concentrations of Polymer 10 (Formulations 4A–C) and 14 (Formulations 5A-B) must be used as compared to Polymer 19 (Formulations 10A-B) or Polymer 20 (Formulations 12A and 12B) to get these results. Polymers 10 and 14 were used neat while Polymers 19 and 20 were used as concentrates. The actual amount of Polymer 19 used in formulation 10A is approximately 0.07 to 0.10 wt. %. Polymer 20, used in Formulations 12A and 12B, yielded results similar to those of Polymer 19. The higher molecular weight (Mw) polymers are more effective on the basis of concentration.

The only other effective pour point depressant was Polymer 17 used in formulation 8. It was the only four component pour point depressant which produced satisfactory formulations. However, it is not effective with VI Improver B (see below).

The other formulations do not work. Formulations 1 and 3 fail miserably. Formulations 2A, 2B and 6 have unacceptably high MRV (D-3829) viscosities. Formulation 6 also suffers from a high Federal Stable Pour. Formulation 9 has a high Federal Stable Pour although its MRV (D-3829) and TP-1 viscosities are acceptable.

Formulations 2A–2B and 7A–7B demonstrate that increasing the pour point depressant concentration can cause a deterioration in the properties of the formulations. The MRV viscosity, with the D-3829 cooling cycle, increases for Polymer 5 in formulations 2A and 2B. The stable pour increased in formulations 7A and 7B when the concentration and Polymer 16 was increased.

Formulations 11A–C use Acryloid 154-70 as the pour point depressant. Formulations 11A and 11B have stable pour problems. The MRV viscosities also increase to unacceptably high levels when the Acryloid 154-70 concentration is increased to 1.0 wt. % (Formulation 11C).

The three component pour point depressant that has a $C_{10}$, $C_{14}$, and $C_{16}$ chain distribution and the four component pour point depressant with the $C_{10}$, $C_{11}$, $C_{14}$ and $C_{16}$ chain length distributions are the best pour point depressants tested. They produce formulations with better low temperature properties than either Acryloid 154-70 or any of the other experimental pour point depressants. For the latter polymers, it is not clear why certain three or four components function in the presence of DOCP VI improvers and other three or four chain combinations do not. It is also not clear why a three component pour point depressant should work better than almost all of the four component pour point depressants and the five component pour point depressants.

Olefin Copolymer VI Improver B Formulations

The low temperature properties of the VI Improver B formulations are displayed in Table 4.

Formulations 2A, 2B, 3, 8 and 12 have acceptable stable pours, CCS viscosities and MRV (D-3829) viscosities. Formulations 2-3 contain Polymers 5 or 6; these polymers contain the same chain distribution, and they differ only in molecular weight. There does not seem to be any difference in overall performance of the formulation due to molecular weight for Polymers 5 or 6. Only Polymer 19 or Polymer 20 (see Table 5) functions effectively with both VI Improver A or VI Improver B. The other polymers work successfully with only one of the VI improvers. Polymer 5 fails with VI Improver A, formulation 2A-B in Table 3, but works effectively with VI Improver B, formulations 2A-B in Table 4. Polymer 17 functions with VI Improver A, formulation 8 in Table 3, but fails with VI Improver B, formulation 10 in Table 4. Polymer 15 functions effectively with VI Improver B, formulation 8, in Table 4, but is not effective with VI Improver A, formulation 6, Table 3. These results indicate that a pour point depressant can be tailored for each DOCP VI improver.

The other formulations have high MRV viscosities in the standard cooling cycle (formulation 7) or with the TP-1 cycle (Formulations 7, 9–11).

Formulation 13 contains Acryloid 154-70. While it has acceptable MRV viscosities in both the D-3829 and TP-1 cooling cycles, the stable pour is too high. The experimental pour point depressants described in Tables 1 and 2 produce better 5W-30 formulations.

The failure of Polymer 7 in formulation 4 is an interesting contrast to the success of Polymer 6 in Formulation 3. The only difference between the two pour point depressant polymers is that Polymer 7 contains butyl groups. The butyl groups may be interfering with the success of the formulation.

Miscellaneous Formulations

Various VI/DI package combinations were tested with polymers 19 or 20 in Atlas 100N as potential 5W-30 formulations. The low-temperature viscometric properties of the formulations are displayed in Table 5. Both pour point depressant concentrates, polymers 19 and 20, function effectively with a variety of VI/DI package combinations, producing formulations with very good low-temperature properties. The poly (methacrylate) with a $C_{10}$, $C_{14}$, and $C_{16}$ chain distribution with a Cav of 12.6–13.0 is a versatile pour point depressant.

Several 10W-30 and 10W-40 formulations were tested with Polymer 20 in Atlas base stocks. The low-temperature results of the formulations are collated in Table 6. The 10W series is required to have $\leqq -30°$ C. Federal Stable Pour, a CCS viscosity of $\leqq$3500 cP at $-20°$ C., and a viscosity of $\leqq$30,000 cP at $-25°$ C. in both the 18-hour and TP-1 cooling cycles. formulations with Polymer 20 quite easily surpassed these requirements. The fact that the pour point depressant functions in 5W-30s, 10W-30s, and 10W-40s makes it an attractive, versatile additive.

The pour point depressant, Polymer 19, was tested in Ashland 100N with very good results shown in Table 7. The 5W-30 formulations had very good low-temperature properties, indicating that the pour point depressant is not limited to only one base stock.

In conclusion, eleven poly(methacrylates) with an effective side chain length of 12.6–13.3 carbon atoms were effective pour point depressants in Atlas 100N as long as no other additives were present When the pour point depressants were tested in formulations with a detergent package and a DOCP VI Improver, only one of the eleven pour point depressants was compatible with the two DOCP VI Improvers. This unique pour point depressant has a specific combination of three chain lengths, $C_{10}$, $C_{14}$ and $C_{16}$. Pour point depressants with two, four or five chains will produce formulations with compatibility problems, poor low temperature properties, or will be successful with only one of the DOCP VI improvers. Three component pour point depressants that do not have $C_{10}$, $C_{14}$ and $C_{16}$ will also produce problem formulations.

TABLE 3

Formulations with Olefin Copolymer VI Improver A

| Formulation | PPD Polymer | PPD % | DI A | VI A | Atlas 100N | Pour Point °F. | Stable Pour, °C. | CCS, cP −25° C. | MRV, cP −30° C. | TP-1 cP, −30° C. | Vis 40° C., 100° C., VI |
|---|---|---|---|---|---|---|---|---|---|---|---|
| 1 | 4 | 0.25 | 8.95 | 10.5 | 80.30 | −5 | — | 3700 | Frozen | — | 69.13, 11.53, 162 |
| 2A | 5 | 0.25 | 8.96 | 10.57 | 80.22 | −30 | — | 2656 | 40384 | — | 70.03, 11.67, 162 |
| 2B | 5 | 0.42 | 8.86 | 10.97 | 79.75 | −35 | — | 3225 | 46080 | — | 73.12, 12.18, 164 |
| 3 | 9 | 0.38 | 8.69 | 10.56 | 80.37 | −5 | — | — | — | — | 69.54, 11.66, 163 |
| 4A | 10 | 0.44 | 9.1 | 10.52 | 79.94 | −35 | −38 | 3150 | 25616 | 23201 | 71.00, 11.87, 167 |
| 4B | 10 | 0.25 | 9.03 | 10.52 | 80.70 | −30 | −32 | 3425 | 25533 | 24416 | 70.26, 11.62, 160 |
| 4C | 10 | 0.1 | 9.10 | 10.46 | 80.34 | −30 | −32 | 3350 | 23772 | 25085 | 69.49, 11.49, 160 |
| 5A | 14 | 0.265 | 9.02 | 10.50 | 80.21 | −32 | −32 | 3175 | 24746 | 24678 | 70.46, 11.69, 162 |
| 5B | 14 | 0.35 | 9.05 | 10.51 | 80.09 | −39[a] | −41 | 3250 | 24107 | 20308 | 71.05, 11.87, 164 |
| 6 | 15 | 0.25 | 9.06 | 10.54 | 80.15 | −30 | −20 | 3350 | 43251 | 68690 | 70.66, 11.66, 160 |
| 7A | 16 | 0.25 | 9.21 | 10.37 | 80.17 | −30 | −32 | 3400 | 23735 | 23849 | 69.56, 11.53, 160 |
| 7B | 16 | 0.39 | 9.06 | 10.60 | 9.95 | −39[a] | −23 | 3250 | 24802 | 19119 | 89.98, 11.74, 164 |
| 8 | 17 | 0.25 | 9.48 | 10.52 | 79.75 | −30 | −35 | 3450 | 24605 | 25297 | 70.98, 11.73, 161 |
| 9 | 18 | 0.249 | 8.77 | 10.27 | 80.71 | −30 | −20 | 3325 | 21825 | 21870 | 68.47, 11.44, 162 |
| 10A | 19 | 0.24[b] | 9.15 | 10.56 | 80.05 | −33[a] | −38 | 3325 | 22663 | 20802 | 69.58, 11.65, 163 |
| | | | | | | | | 25 | 81 | | |
| 10B | 19 | 0.59[b] | 9.03 | 10.51 | 79.87 | −25 | −38 | 3225 | 26690 | 20,145 ± 13 | 70.63, 11.82, 164 |
| | | | | | | | | | (yield stress 35) | | |
| 11A | Acryloid 154–70 | 0.28 | 9.14 | 10.53 | 80.05 | −25 | −32 | 3400 | 24391 | 25379 | 69.49, 11.59, 162 |

TABLE 3-continued

| Formulations with Olefin Copolymer VI Improver A | | | | | | | | | | | |
|---|---|---|---|---|---|---|---|---|---|---|---|
| Formulation | PPD Polymer | PPD % | DI A | VI A | Atlas 100N | Pour Point °F. | Stable Pour, °C. | CCS, cP −25° C. | MRV, cP −30° C. | TP-1 cP, −30° C. | Vis 40° C., 100° C., VI |
| 11B | Acryloid 154–70 | 0.52 | 9.00 | 10.01 | 79.87 | −30 | −32 | 3350 | 25724 | 24997 | 70.70, 11.76, 162 |
| 11C | Acryloid 154–70 | 1.0 | 9.26 | 10.54 | 79.2 | −25 | — | 3600 | 29146 | 27681 589 | 77.29, 12.04, 164 |
| 12A | 20 | 0.25[b] | 9.17 | 10.58 | 80.0 | — | −38 | 3250 | 18682 | 21412 | 70.25, 11.82, 161 |
| 12B | 20 | 0.37[b] | 0.28 | 10.48 | 79.87 | — | −38 | 3100 | 18804 | 21842 | 70.51, 11.81, 164 |

[a]in °C.
[b]concentrate

TABLE 4

| Olefin Copolymer VI Improver B | | | | | | | | | | | |
|---|---|---|---|---|---|---|---|---|---|---|---|
| Formulation | PPD Polymer | PPD % | DI A | DI B | Atlas 100N | Pour Point, °F. | Stable Pour, °C. | CCS, cP −25° C. | MRV, cP −30° C. | TP-1 cP, −30° C. | Vis 40° C., 100° C., VI |
| 1 | 4 | 0.27 | 8.97 | 15.98 | 74.78 | −30 | — | 2925 ± | Frozen | — | 83.25, 13.58, 167 |
| 2A | 5 | 0.247 | 9.07 | 13.9 | 76.77 | −30 | −38 | 2894 ± | 21880 | — | 73.3, 11.82, 157 |
| 2B | 5 | 0.41 | 9.07 | 13.91 | 76.67 | −35 | −38 | 2854 | 18681 | — | 73.13, 12.07, 162 |
| 3 | 6 | 0.248 | 9.13 | 13.84 | 76.78 | −30 | −38 | 3225 ± | 20510 | 20282 | 71.3, 11.77, 159 |
| 4 | 7 | 0.252 | 9.05 | 13.83 | 76.89 | −25 | — | — | <1,060,000 | — | 71.34, 11.79, 161 |
| 5 | 8 | 0.25 | 8.94 | 14.15 | 76.67 | −25 | — | 2850± | Frozen | — | 73.31, 11.86, 157 |
| 6A | 10 | 0.1 | 9.03 | 13.99 | 76.88 | −35 | — | 3000 | 24375 | 30829 | 72.61, 11.75, 157 |
| 6B | 10 | 0.25 | 9.30 | 13.90 | 76.55 | −30 | — | 3225± | 25931 | 26171 | 72.16, 11.75, 158 |
| 6C | 10 | 0.44 | 9.02 | 14.00 | 76.54 | −35 | — | 3350± | 26403 yield stress 35 | 17902 | 73.84, 12.14, 162 |
| 7 | 14 | 0.248 | 9.01 | 13.75 | 76.99 | −30 | — | 2950 | 26600 | 28860 | 72.02, 11.78, 159 |
| 8 | 15 | 0.25 | 9.02 | 13.73 | 77.00 | −30 | −35 | — | 22345 | 21417 | 71.00, 11.59, 158 |
| 9 | 16 | 0.249 | 9.10 | 13.67 | 76.98 | −40 | — | 3275 | 24755 | 27394 | 71.20, 11.59, 158 |
| 10 | 17 | 0.25 | 9.05 | 13.86 | 76.84 | −30 | — | 3000 | 26919 | 29298 | 71.95, 11.74, 159 |
| 11 | 18 | 0.25 | 8.93 | 15.35 | 75.45 | −35 | — | 3350 | 29469 | 27325 | 78.55, 12.65, 160 |
| 12 | 19 | 0.56[a] | 9.01 | 13.63 | 76.70 | −30 | −35 | 2900 | 26889 | 23663 ± 137 | 72.35, 11.89, 161 |
| 13 | Acryloid 154–70 | 0.27[a] | 8.98 | 13.55 | 77.20 | −25 | −32 | 3250 | 22655 | — | 70.00, 11.40, 156 |

[a]concentrate

TABLE 5

| Pour Point Depressant Performance with different DI/VI package combinations. Concentration in weight percent. Basestock is Atlas 100N. | | | | | | | | |
|---|---|---|---|---|---|---|---|---|
| PPD | % PPD | DI, % | VI, % | Stable Pour, °C. | MRV, −30° C. | TP-1, −30° C. | CCS, −25° C. | Vis 40, VI 100° C. |
| 19 | 0.26 | B, 8.48 | A, 10.66 | −38 | 17041 | 18894 | 3205 | 68.15, 11.47 103 |
| 19 | 0.21 | C, 7.05 D, 1.2 | A, 10.59 | −38 | 14957 | 16691 | 2925 | 65.02, 11.07 163 |
| 20 | 0.24 | C, 6.85 D, 1.08 | B, 15.57 | −38 | 16203 | 20172 | 3000 | 73.34, 11.99 160 |
| ECA 7955 | 0.5 | C, 6.85 D, 1.08 | B, 15.57 | −29 | 25616 | 27953 | 2800 | 69.34, 11.25 159 |

TABLE 6

| Pour Point Depressant Performance in 10W30s and 10W40s with selected basestocks. Polymer 20, Table 2, was used as the pour point depressant. | | | | | | | | |
|---|---|---|---|---|---|---|---|---|
| % PPD | Basestocks | VI, % | DI, % | MRV −25° C. | TP-1, −25° C. | CCS −20° C. | Stable Pour, °C. | Vis 100°C. |
| 0.22 | Atlas 100N, 300N[a] | A, 7.72 | E, 7.54 | 11993 | 12756 | 3075 | −44 | 11.51 |
| 0.249 | Atlas 100N, 300N[b] | A, 12.49 | E, 7.46 | 16361 | 16634 | 3025 | −39 | 15.60 |

[a]10W30
[b]10W40

TABLE 7

| Pour Point Depressant Performance in Ashland 100N 5W-30 Formulation Polymer 19. Table 2 is the pour point depressant. Concentration is in weight percent. | | | | | | |
|---|---|---|---|---|---|---|
| PPD | VI | DI | MRV −30° C. | TP-1, −30° C. | CCS, −25° C. | Stable Pour, °C. |
| 0.27 | 14.52 VI improver B | 7.0 Package C 0.99 Package D | 15023 | 17099 | 2675 | −41 |
| 0.258 | 14.52 VI improver B | 8.51 Package B | 15344 | 18641 | 2850 | −44 |

TABLE 7-continued

Pour Point Depressant Performance in Ashland 100N 5W-30 Formulation Polymer 19. Table 2 is the pour point depressant. Concentration is in weight percent.

| PPD | VI | DI | MRV −30° C. | TP-1, −30° C. | CCS, −25° C. | Stable Pour, °C. |
|---|---|---|---|---|---|---|
| 0.26 | 10.61 VI improver A | 9.07 Package A | 16620 | 19029 | 3000 | −41 |

EXAMPLE 5

In order to compare a preferred pour point depressant of the present invention, calculations are made using the calculation formula of U.S. Pat. No. 3,814,690 to compare the average carbon side chain length of Polymer 19 of this invention with pour point depressant polymers disclosed in U.S. Pat. No. 3,897,353. Example A, Table 8A, shows the calculation of the Cav for one 200 gram alcohol mixture mentioned in column 6 of the U. S. Pat. No. 3,897,353 composed of 150 g of Neodol 25L and 50 g of Alfol 1620 SP. The relative weight distribution shown was calculated by multiplying each alcohol mixture by its respective weight distribution, as described above, adding together the components that overlapped, and then normalizing the new distribution. In the calculation, if a 100 gram alcohol sample is assumed, then there will be 24 g of $C_{12}OH$ (0.24×100 g), 24 g of $C_{13}OH$, etc., as shown in the third column. As the molecular weights, g/mole, are shown in the fourth column, the moles of each component are easily obtained by dividing the weight of alcohol by its molecular weight with the results shown in column 5. The last column, column 6, shows the mole percent of each alcohol which was obtained by multiplying the mole fraction by 100%. The mole fraction is simply the mole of each component divided by the total number of moles The side chain average calculation is shown. The chain average, Cav, for the mixture was calculated to be 14.08.

Example B in Table 8B, shows the methacrylate distribution for polymer 19, Table 2 of this application. By following the same procedures as outlined for Example A, the Cav was calculated to be 12.83.

The tables for these calculations are as follows:

TABLE 8A

Example A. Mixture[a] of Neodol 25L (150 g) Alfol 1620 SP (50 g)

| | Rel. Wt % | Wt | Mw | Mole | Mole Percent (mole fraction × 100%) |
|---|---|---|---|---|---|
| $C_{12}OH$ | 19.25 | 19.25 g | 186.34 | 0.1033 | 23.01 |
| $C_{13}OH$ | 19.25 | 19.25 g | 200.37 | 0.0961 | 21.40 |
| $C_{14}OH$ | 20.32 | 20.32 g | 214.39 | 0.0948 | 21.11 |
| $C_{15}OH$ | 12.03 | 12.03 g | 228.42 | 0.0527 | 11.74 |
| $C_{16}OH$ | 16.31 | 16.31 g | 242.45 | 0.0673 | 14.98 |
| $C_{18}OH$ | 7.22 | 7.22 g | 270.5 | 0.0267 | 5.95 |
| $C_{20}OH$ | 2.41 | 2.41 g | 298.56 | 0.0081 | 1.80 |

$$\frac{(23.01)(12) + (21.40)(13) + (21.11)(14) + (11.74)(15) + 14.98(16) + 5.95(18) + 1.80(2)}{100}$$

Cav = 14.08

[a]Two assumptions are made. In the Alfol 1620 SP mixture, the fraction that is "$C_{14}OH$ and lighter" is assumed to be 100% $C_{14}OH$. In the Neodol 25L mixture, the fraction that is "lighter than $C_{12}OH$" is ignored. If that fraction is assumed to be pure $C_{10}OH$, then the Cav equals 13.90.

TABLE 8B

Example B. Polymer 19

| | Rel. Wt % | Wt | Mw | Mole | Mole Percent (mole fraction × 100%) |
|---|---|---|---|---|---|
| $C_{10}$Meth | 35.8 | 35.8 g | 226.36 | 0.1582 | 42.14 |

TABLE 8B-continued

Example B. Polymer 19

| | Rel. Wt % | Wt | Mw | Mole | Mole Percent (mole fraction × 100%) |
|---|---|---|---|---|---|
| $C_{14}$Meth | 33.8 | 33.8 g | 282.46 | 0.1197 | 31.88 |
| $C_{16}$Meth | 30.3 | 30.3 g | 310.52 | 0.0976 | 25.98 |

$$\frac{(42.14)(10) + (31.88)(14) + (25.98)(16)}{100}$$

As will be seen from Example A, the calculations show that the average side chain length is 14.08. In Example B, which is Applicants, polymer 19, the average side chain length is 12.83.

EXAMPLE 6

The pour point depressants of this invention were evaluated with various detergent packages used in lubricating oils. In this work, additional pour point depressants were prepared.

Compositions and molecular weight distributions, (MWDs), of three pour point depressants that share the same components decyl methacrylate ($C_{10}$ meth), tetradecyl methacrylate ($C_{14}$ meth), and hexadecyl methacrylate ($C_{16}$ meth), but in different proportions, to give three different side chain averages, Cav, are shown in Table 9. The polymers in concentrates 21, 22 and 23 have very similar MWDS as well as polymer loads It should be pointed out the polymers 19 and 20 in Table 2 of the application are really concentrates containing those polymers The polymers in concentrates 20 and 21 are essentially the same; both have the same methacrylate compositions that yield basically identical Cavs and very similar MWDS. The only difference between the two concentrates is that concentrate 20 is approximately 25 wt % polymer while concentrate 21 is approximately 40–45 wt % polymer.

TABLE 9

Composition of pour point depressants. Normalized weight distribution of starting methacrylate monomer mixture, side chain average, Cav, molecular weight distribution of resulting polymer and polymer content of concentrate.

| Concentrate # | $C_{10}$ meth. | $C_{14}$ meth. | $C_{16}$ meth. | Cav | $M_w$ | $M_n$ | % Polymer |
|---|---|---|---|---|---|---|---|
| 21 | 36.5 | 35.0 | 28.5 | 12.78 | 179,000 | 48,200 | 40–45 |
| 22 | 29.1 | 37.8 | 33.1 | 13.16 | 155,000 | 53,000 | 40–45 |
| 23 | 25.2 | 40.5 | 34.3 | 13.38 | 183,000 | 73,000 | 40–50 |

Olefin copolymer viscosity index improver concentrate C was used in the formulations. It is similar in nature to olefin copolymer concentrate A discussed in Example 4 of the application. However, it has a lower molecular weight than A. The lower molecular weight is believed to make the polymer less likely to shear in the engine. Viscosity Index (VI) improvers with this property have only recently been introduced in the industry; they are called shear stable VI improvers.

Several different detergent packages were used in the formulations. They are at the SG level of detergency. Detergent package F, at SG performance levels, is used in formulations displayed in Tables 10 and 11. It uses polyisobutylene dispersant chemistry. The SF version of this DI package, identified as detergent package H, is used in Table 11. Detergent package F is 25 wt % dispersant while H is 19 wt % dispersant. Detergent package G is a spike composed of calcium phenates and sulfonates to give additional performance. Detergent package I uses Mannich dispersant chemistry. Detergent package I is approximately 23 wt % dispersant. Detergent package J employs polyisobutylene succinimide dispersant chemistry. The above description is merely qualitative as these packages are composed of other additives that serve different purposes. The low temperature properties of the 5W30 formulations with the various PPD concentrates are displayed in Table 10.

The 18 hr and TP-1 MRV viscosities are essentially the same. In the 5W30 formulations, the viscosities are independent of treat level and Cav.

The stable pour data does show a trend toward higher stable pours with increasing treat rates of the concentrates. Compare entries 1-3 for concentrate 21 where the stable pour increases from ≦−41° to −36° C. as the treat rates increases from 0.06 wt % to 0.31 wt %. Within the limits of experimental error, there is an increase in the stable pour as the Cav increases (at low treat rates). Compare entry 1, where the stable pour is ≦−41° C. at a treat rate of 0.07 wt % for concentrate with a Cav of 12.78, to entry 4, where the stable pour is −39° C. at a treat rate of 0.15 wt % for the concentrate with a Cav of 13.16, to entry 6, where the stable pour is −36° C. at a treat rate of 0.10 wt % for the concentrate with a Cav of 13.38. While a stable pour of −36 is acceptable for a 5W30 oil, it would be more desirable to have a formulation with a lower stable pour because of the better low temperature properties it affords the formulation as well as the cushion it affords in the 3° C. margin of error allowed in the measurement.

The trend toward higher pour points with increasing Cav was demonstrated in D-97 pour points discussed earlier, see FIG. 1. It is pointed out that the D-97 pour point and the stable pour are similar in name only; they are completely different tests. A D-97 pour point test is conducted over a few hours and is basically a straight cooling test. Refiners use it as a quality control test for base stocks. While it was originally used in formulation work, it has been rendered obsolete by a battery of other tests, including the stable pour. At least one company has renamed their pour point depressants lube oil flow improvers to reflect this change The stable pour test is conducted over a period of 7 days with heating and cooling cycles. It is used for formulations because there is some relationship between the test and the performance of the formulation in the real world. Its major flaw is that it takes 7 days to complete and is therefore not a good quality control tool for production work.

The PPD concentrates were also tested in 10W30 formulations. The results of one 10W30 series is displayed in Table 11. The detergent package H, of SF quality, is used in entry 1. Concentrate 21 with a Cav of 12.78 is fairly effective in the formulation. The concentrate does not function when the detergent package is switched to the SG detergent package F. The formulation freezes solid in the TP-1 MRV, entry 2. The situation improves when the treat rate is increased, but the results are still not acceptable, entry 3. The situation dramatically improves when the concentrates with the higher Cavs are used. The yield stress disappears when concentrate 22 with a Cav of 13.6, entry 4, or concentrate 23 with a Cav of 13.38, entry 5, are employed The occurrence of yield stress and its subsequent relief occurred in a second 10W30 formulation series shown in Table 12. The SG detergent package I was used. Concentrate 21 with a Cav of 12.78 displayed yield stress at two different treat rates, entries 1 and 2. The yield stress disappeared when concentrate 22 with a Cav of 13.16, entry 3, or concentrate 23 with a Cav of 13.38 are employed, entry 4. The stable pours in both 10W30 series are quite acceptable.

Concentrate 21 was tested in 10W30s and 10W40s composed of Chevron basestocks. The concentrates and low temperature results are displayed in Table 13. The results are excellent.

Finally, concentrate 21 was tested in 15W40s. The formulations and results are displayed in Table 14. The results are excellent.

For the 5W30 and 10W30s that were examined the following conclusions can be drawn;

(1) In 5W30s, the stable pours but not the TP-1 MRV viscosities are dependent on the Cav.

(2) In the 10W30s, the TP-1 MRV viscosities but not the stable pours were affected by the Cav.

Tables 10, 11, 12, 13, 14 and 15 are presented below.

TABLE 10

Pour point depressant performance in 5W-30 oil. A common formulation composed of 9.07 wt % Olefin Copolymer Concentrate C, 11.25% Detergent Package F, 2.0% Detergent Package G, and 77.08% Atlas 100N was used. The formulation had a kin. vis. of 11.65 cSts at 100° C.

| Concentrate | Cav | % PPD | 18 hr. MRV, −30° C. | TP-1 MRV, −30° C. | Stable Pour °C. |
|---|---|---|---|---|---|
| (1) 21 | 12.78 | 0.06 | 18,500 | 20,000 | <−41 |
| (2) 21 | 12.78 | 0.15 | 19,200 | 18,800 | −36 |
| (3) 21 | 12.78 | 0.31 | 21,300 | 19,900 | −36 |
| (4) 22 | 13.16 | 0.15 | 19,900 | 19,900 | −39 |
| (5) 22 | 13.16 | 0.20 | 21,500 | 20,900 | −36 |
| (6) 23 | 13.38 | 0.10 | 18,300 | 19,400 | −36 |
| (7) 23 | 13.38 | 0.165 | 19,700 | 19,700 | −36 |
| (8) 23 | 13.38 | 0.294 | 21,200 | 20,500 | −36 |

TABLE 11

Pour point depressant performance in 10W-30. The stock formulation was composed of 6.39 wt % Olefin Copolymer Concentrate C, 11.90% Detergent Package F, 28.0% Atlas 325 and 54.3% Atlas 100N. Entry 1 used detergent package H at 11.28 wt %, Olefin Copolymer Concentrate C at 6.38%, Atlas 100N at 54.33% and 28.0% Atlas 325N.

| Concentrate | Cav | % PPD | TP-1 | Stable Pour, °C. |
|---|---|---|---|---|
| (1) 21 | 12.78 | 0.14 | 15,300 | −39 |
| (2) 21 | 12.78 | 0.14 | Solid | −33 |
| (3) 21 | 12.78 | 0.25 | 47,000 YS = 245 | |
| (4) 22 | 13.16 | 0.20 | 16,500 | −39 |
| (5) 23 | 13.38 | 0.15 | 16,500 | −36 |
| (6) 23 | 13.38 | 0.24 | 16,200 | −36 |

TABLE 12

Pour point depressant performance in 10W-30 composed of 6.5% Olefin Copolymer Concentrate C, 12.2% Detergent Package I, 58.9% Atlas 100N and 22.3% Atlas 325N.

| Concentrate | Cav | % PPD | MRV, −25° C. | TP-1, −25° C. | Stable Pour |
|---|---|---|---|---|---|
| (1) 21 | 12.78 | 0.11 | 10,800<br>YS = 140 | 58,000 | −30 |
| (2) 21 | 12.78 | 0.20 | 10,500<br>YS = 70 | 32,100 | −36 |
| (3) 22 | 13.16 | 0.19 | 15,300 | 15,300 | −39 |
| (4) 23 | 13.38 | 0.198 | 13,900 | 14,000 | −36 |

TABLE 13

Performance of pour point depressant concentrate 22 in 10W30s and 10W40s composed of Chevron basestocks.

| | 10W30 | 10W30 | 10W40 |
|---|---|---|---|
| Wt % PPD | 0.154 | 0.155 | 0.16 |
| Olefin Copolymer C | 7.11 | 6.45 | 11.03 |
| Detergent Package I | 10.14 | 12.10 | 11.33 |
| Chevron 100N | 59.13 | 52.43 | 60.95 |
| Chevron 240N | 23.45 | 28.93 | 16.53 |
| Results | | | |
| Stable Pour, °C. | <−41 | <−41 | <−41 |
| TP-1 MRV, −25° C. | 9,200 | 10,800 | 12,200 |
| 18 hr MRV, −25° C. | 15,300 | 7,700 | 9,700 |

TABLE 14

Performance of pour point depressant concentrate 22 in 15W 40s

| | | |
|---|---|---|
| Wt % PPD | 0.2 | 0.14 |
| Detergent Package I | 13.78 | 14.10 |
| Olefin Copolymer C | 9.07 | 10.35 |
| Atlas 100N | 40.47 | — |
| Atlas 325N | 27.41 | — |
| Chevron 100N | — | 28.88 |
| Chevron 240N | — | 36.98 |
| Brightstock | 9.07 | 9.56 |
| Results | | |
| Stable Pour, °C. | −36 | <−41 |
| TP-1 MRV, −20° C. | 11,700 | 11,800 |
| 18 hr MRV, −20° C. | 10,200 | 13,300 |

The invention has been described herein with reference to certain preferred embodiments. However, as obvious variations thereon will become apparent to those skilled in the art, the invention is not to be considered as limited thereto.

What is claimed is:

1. A pour point depressant for lubricating oils comprising a poly(methacrylate) polymer having the repeating unit

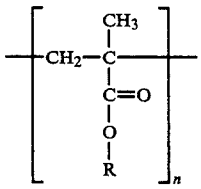

wherein R is an alkyl group having an average chain length in the polymer of 12.6 to 13.8, and n is an integer indicating the number of repeating units, the value of n being sufficient to provide a molecular weight of 10,000 to 300,000 for the polymer, said polymer being a polymer formed from the reaction of at least three but less than five methacrylate monomers with no individual monomer present in an amount of less than 10–15 wt. %.

2. A pour point depressant according to claim 1 wherein the polymer is prepared by polymerization of at least three but less than five methacrylate monomers of the formula

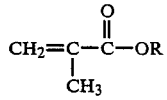

wherein R may range from 8 to 20 carbon atoms.

3. A pour point depressant according to claim 2 wherein the value of R ranges from 10 to 16 carbon atoms.

4. A pour point depressant according to claim 2 wherein each monomer is present in an amount not less than 10 wt. %, when the monomers are polymerized, and wherein the value of R is selected from the group consisting of $C_{10}$, $C_{11}$, $C_{12}$, $C_{14}$, and $C_{16}$.

5. A pour point depressant according to claim 4 wherein the polymer is formed from monomer mixtures wherein R is $C_{10}$, $C_{14}$ and $C_{16}$.

6. A pour point depressant according to claim 4 wherein 3 monomers are used where each monomer is not less than 20 wt. % of the polymer wherein the monomers are $C_{10}$, $C_{14}$ and $C_{16}$.

7. A pour point depressant according to claim 1 wherein the average chain length in the polymer is 12.6 to 13.5.

8. A pour point depressant according to claim 1 wherein the average chain length in the polymer is 12.8 to 13.3.

9. A lubricating oil composition comprising a wax containing hydrocarbon lubricating oil, said lubricating oil containing a sufficient amount of a pour point depressant to reduce the stable pour point to −35° C., said pour point depressant comprising an effective amount of a polyalkylmethacrylate having the repeating unit

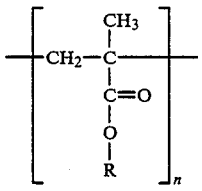

wherein R is an alkyl group having an average chain length in the polymer of 12.6 to 13.8, and n is an integer indicating the number of repeating units, the value of n being sufficient to provide a molecular weight of 10,000 to 300,000 for the polymer, said polymer being a polymer formed from the reaction of at least three but less than five methacrylate monomers with no individual monomer present in an amount of less than 10–15 wt. %.

10. A lubricating oil composition according to claim 9 wherein the polymer is prepared by polymerization of at least three but less than five methacrylate monomers and each monomer is present in an amount of at least 10–15 wt. % of methacrylate monomers of the formula

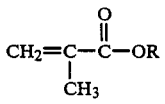

wherein R range from 10 to 20 carbon atoms.

11. A lubricating oil composition according to claim 9 wherein the value of R ranges from 10 to 16 carbon atoms.

12. A lubricating oil composition according to claim 9 wherein the average chain length of the polymer is 12.8 to 13.5.

13. A lubricating oil composition according to claim 9 wherein the average chain length of the polymer is 12.8 to 13.3.

14. A lubricating oil composition according to claim 9 wherein the value of R is selected from the group consisting of $C_{10}$, $C_{11}$, $C_{12}$, $C_{14}$, and $C_{16}$.

15. A lubricating oil composition according to claim 11 wherein the polymer is formed from a mixture of monomers wherein R is $C_{10}$, $C_{14}$ and $C_{16}$ and each monomer comprises at least 25% of the polymer.

16. A lubricating oil composition according to claim 9 which also contains a viscosity index improver.

17. A lubricating oil composition according to claim 16 where the viscosity index improver comprises an ethylene propylene copolymer.

18. A lubricating oil composition according to claim 9 which also contains a detergent.

19. A lubricating oil composition according to claim 18 wherein the detergent is an SE, SF or SG detergent.

20. A lubricating oil composition comprising a wax containing hydrocarbon lubricating oil and containing a sufficient amount of a pour point depressant to reduce the pour point to comply with the requirements of a 5W-30, 10W-30, 10W-40 or 15W-40 lubricating oil in combination with a viscosity index improver, said pour point component comprising an effective amount of a poly(methacrylate) polymer having the repeating unit

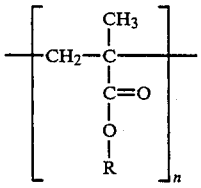

wherein R is an alkyl group having an average chain length in the polymer of 12.6 to 13.8, and n is an integer indicating the number of repeating units, the value of n being sufficient to provide a molecular weight of 10,000 to 300,000 for the polymer, the pour point depressant having been formed by reaction of at least three but less than five methacrylate monomers where each monomer is at least 10–15 wt. % of the mixture having the formula

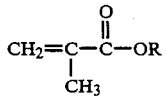

wherein R is selected from the group consisting of $C_{10}$–$C_{16}$ alkyl groups, the value of R being chosen so that the average chain length in the polymer of the R group is 12.6–13.8.

21. A lubricating composition according to claim 20 which also includes a detergent.

22. A lubricating composition according to claim 20 wherein the average chain length in the polymer is 12.6 to 13.5.

23. A lubricating oil composition according to claim 20 wherein the viscosity index improver comprises an ethylene propylene copolymer.

24. A lubricating oil composition according to claim 20 wherein the pour point depressant is added as a concentrate in an amount of 0.001 to 1.0 wt. %, based on the total amount of lubricating oil.

25. A lubricating oil composition according to claim 21, wherein the viscosity index improver is present in an amount of 5 to 20 wt. %, based on the amount of lubricating oil.

26. A method for depressing the pour point of a lubricating oil composition which comprises adding to the lubricating oil a pour point depressing effective amount of a poly(methacrylate) polymer having the repeating unit

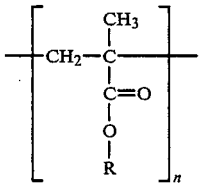

wherein R is an alkyl group having an average chain length in the polymer of 12.6 to 13.8, and n is an integer indicating the number of repeating units, the value of n being sufficient to provide a molecular weight of 10,000 to 300,000 for the polymer, said polymer being a polymer formed from the reaction of at least three but less than five methacrylate monomers with no individual monomer present in an amount of less than 10–15 wt. %.

27. A method according to claim 26 wherein the effective amount of pour point depressant is 0.001 to 1.0 wt. % based on the total amount of lubricating oil.

* * * * *